US006089391A

United States Patent [19]

Abelbeck et al.

[11] Patent Number: 6,089,391

[45] Date of Patent: Jul. 18, 2000

[54] CONTAINER CAP AND SYSTEM

[75] Inventors: Kevin G. Abelbeck, Venice, Calif.; Annette Umphlett, 709 Townsend Ave., New Haven, Conn. 06512

[73] Assignee: Annette Umphlett, New Haven, Conn.

[21] Appl. No.: 09/102,437

[22] Filed: Jun. 22, 1998

[51] Int. Cl.[7] ..... B65D 51/24

[52] U.S. Cl. ..... 215/303; 215/228; 215/295; 215/297

[58] Field of Search ..... 215/226, 228, 215/295, 297, 301, 302, 303

[56] References Cited

U.S. PATENT DOCUMENTS

| | | | |
|---|---|---|---|
| 3,581,605 | 6/1971 | Taylor | 215/297 X |
| 3,661,289 | 5/1972 | Segmuller . | |
| 4,340,147 | 7/1982 | McIntosh | 215/226 |
| 4,739,891 | 4/1988 | Bullock, III . | |
| 4,754,890 | 7/1988 | Ullman . | |
| 4,790,220 | 12/1988 | Lloyd . | |
| 4,845,844 | 7/1989 | Allen . | |
| 4,869,399 | 9/1989 | Dubach . | |
| 5,007,546 | 4/1991 | Rose et al. . | |
| 5,090,582 | 2/1992 | Art et al. | 215/250 |
| 5,148,937 | 9/1992 | Huard . | |
| 5,372,268 | 12/1994 | Han . | |
| 5,615,788 | 4/1997 | Larguia . | |
| 5,758,788 | 6/1998 | Lifshey | 215/278 |

*Primary Examiner*—Stephen K. Cronin

[57] ABSTRACT

A novel container cap and containment system is disclosed which includes a cap with an upper and a lower portion, being removable one from the other. The upper portion has an upper wall that is continuous with an outer rim. The outer rim is constructed such that it fits over the orifice of a container. A blade is included inside of the peripheral edge of the outer rim and preferably extends from the upper wall. The lower portion of the cap has one end that is capable of receiving the end of the upper portion opposite to the upper wall and a second end that is adapted to be able to be releasably secured about the orifice of the container, the orifice also including a safety seal. The blade, in one embodiment, is preferably oriented in a "C" shape, whereby the cap can be removed from the container and the upper portion oriented over the orifice and depressed therein, thus cutting the safety seal while allowing a small portion to remain, thereby preventing the cut seal from falling into the container. Another embodiment includes a puncture device, also in the upper portion of the cap, the puncture device being capable of penetrating and securing the safety seal so that the seal can be completely cut and not fall into the container. The cap can be replaced on the container, thereafter functioning as a traditional container cap.

37 Claims, 4 Drawing Sheets

CONTAINER CAP AND SYSTEM

BACKGROUND OF THE INVENTION

1. Field of the Invention

The invention herein relates to a bottle cap and more particularly to a bottle cap and container that facilitates the removal of a safety seal on the bottle or other container.

2. Overview of Prior Art

Bottles are a part of our everyday lives. Many times the contents of these bottles are intended to be ingested by the user. This may be in the form of solid or liquid food, or pill form such as in the case with medications and dietary supplements. In each case, the consumer must be assured that the contents of the container have not been tampered with. The manufacturers or bottlers commonly use a reinforced aluminum foil safety seal over the orifice of the bottle that must be removed after removing the bottle cap from the bottle, but before dispensing the contents. If the seal has been removed or torn, the consumer is instructed not to use the product contained therein. The safety seal must not be able to be removed and replaced or the purpose of the safety seal would not be recognized.

The safety seal must therefore be damaged or distorted if removed, yet the seal must be somewhat strong and resilient, otherwise the seal would commonly be damaged by normal handling of the container. This combination of qualities necessitates that the seal be somewhat difficult to remove. This is a problem that is especially evident for the elderly where finger dexterity and strength are reduced. Ironically, this population utilizes a great deal of medications and supplements due to the common degeneration in health with age.

The removal of the safety seal can be accomplished by, after removing the cap, plunging a sharp object, such as a knife into the center of the sealed orifice and tearing off and discarding the safety seal in pieces. This is messy and predisposes the user to contaminate the contents with small pieces of the safety seal. Since the seal is commonly made of aluminum, potential ingestion of this material could be harmful.

Many attempts have been made to provide a simple and sanitary method of removing the safety seal after inspection by removing the cap of the container. One such attempt was made by Art et al, in U.S. Pat. No. 5,090,582. Here a bottle cap is disclosed which includes a partitioned cap, there defining an upper and a lower section. A threaded section is included in the lower section to secure the cap to a bottle. The upper section includes a conical puncture means which is intended to puncture a hole in the safety seal of a container and upon rotating the cap, the seal would be cut away. A ramp is included that prevents the puncture means from rotating completely around the orifice of the container, thus providing a small portion of the seal to remain in contact with the bottle, not allowing it to fall in the bottle.

Some serious problems accompany this design. First, since the puncture means is located in the upper section, which must be open to allow, when inverted, placement over the orifice of the bottle to cut the seal, the resultant is a dust receptacle. All sorts of contaminants would settle in the open upper section and when inverted to cut the seal the user would in essence be dumping the contaminants into the bottle. Another contamination problem is with the single puncture means to puncture and then cut the seal. The disclosure shows a conical member, which would be well suited for puncturing but not for cutting. The cutting "edge" would now be the relatively large base of the cone. This would less likely cut than it would "tare" the seal away, producing small fragments of the seal material as it goes, further contaminating the contents of the container the seal is intending to protect.

A cap with a cutting device is disclosed by Huard in U.S. Pat. No. 5,148,937. Here a cap is shown with a pair of diagonal notch's removed. The resultant is a pair of spiked edges that are intended to pierce the safety seal. As before, the cap is then rotated relative to the bottle and the seal is cut away. Also as before, the spikes are exposed to the environment prior to being punctured into the orifice of the container. This means the any contaminants that are evident on the outside of the cap are now exposed to the contents of the container. Another disadvantage to the disclosed is the presence of an exposed sharp edge on the cap at all times. If it can cut through the safety seal it can potentially cut skin if grabbed in the wrong way.

As a further problem, the cutting edge in the afore mentioned disclosure does not appear to be very efficient. This is because when the projections are punctured through the seal and rotated in one direction relative to the orifice of the container, one side will be positioned in the proper angle to be a cutting edge, while the other side will be oriented away from the edge of the orifice, more as a funnel than a knife. While one side might cut, the other side will tend to "mush" the seal, making removal of the seal inefficient at best.

Numerous other attempts have been made to facilitate removal of a safety seal including a bottle specific cap as disclosed in U.S. Pat. No. 5,007,546 by Rose et al. Here a tab is used to enable the user to remove a safety strip which enabled the removal of the cap. This is an expensive solution and therefore not practical for most applications. Such a device is not intended to be used with the commonly used foil safety seal as is used throughout the industry.

Similarly, Segmuller in U.S. Pat. No. 3,661,289 disclosed a bottle cap seal with a tear off safety strip. The limitations of Rose apply here as well, even though this is somewhat simplified over Rose et al, the process still requires the part be molded onto the neck of the bottle, rather than a foil seal that is adhered to the rim of the orifice. Equally functional in purpose but the foil seal is donc so at a substantially reduced cost.

By contrast, a safety seal stripper is disclosed in U.S. Pat. No. 4,790,220 by Lloyd in which a separate apparatus is used to receive the cap and safety seal of a container and when rotated by the user, strip away the safety seal from the container. This is disclosed to be a secondary tool that is used over the cap, not also as a cap, which presents a major drawback. Cap sizes vary from product to product and even within sizes and brands of the same product. In order to be functional, this device would need to be adjustable in size, which it is not disclosed to be done, or the user would need to have a multitude of the devices on hand dependent upon the size of the orifice and cap of the container.

Another foil cutter is disclosed by Allen in U.S. Pat. No. 4,845,844. The disclosure is intended toward cutting foil from bottles with necks such as Champaign bottles. The orientation of the blades that cut the foil are in opposition to each other therefore making penetration into the orifice of a bottle virtually impossible. Modification to the device to make it functional in this regard would make it distinctly different from this disclosure.

Examples of the seal itself are disclosed by Ullman et al., in U.S. Pat. No. 4,754,890 and Han in U.S. Pat. No.

5,372,268 both which include a tab that can be grasped by the user to tear the seal away. Such a device was not uncommon in the industry for a while. The short coming is obvious in that the tab must fit comfortably under the cap of the container, thus it must be small in size. This means that it will be difficult for many individuals to grasp and pull. As previously mentioned this problem is especially evident for the elderly, who commonly require products such as medications that come in safety sealed containers.

Another cap that utilizes a safety seal is disclosed by Dubach in U.S. Pat. No. 4,869,399 in which a penetrator is used to puncture a hole in the foil which then allows the material to flow from the container into a cavity under the spout opening and then through the same to the user. One major disadvantage in this design is since the penetrator must be adjacent to the spout there is no way to know for sure if the safety seal has been broken prior to first using the container, because it cannot be easily seen by looking in the only visible orifice, the spout. This defeats the purpose of the safety seal. It could be tampered with or even removed and it would not be readily apparent to the user.

A device as disclosed by Larguia in U.S. Pat. No. 5,615,788 includes a cap that incorporates a safety seal and a paper seal. The paper seal is intended to break if the two cap structures are moved relative to one another, thus indicating that the inner seal may be tampered with. The device requires a hook that is pressed into a groove on the bottle neck to hold the internal structure of the device in place. Many bottle openings are threaded to accept a threaded cap. This device would not function because the internal structure must be rigid to the bottle, as compared to a threaded cap which must obviously rotate about the threads. Also, the actual foil seal is not viewed by the user prior to opening. The paper seal is only an indicator. This increases the likelihood of false evaluations of tampering that do not in fact exist. This causes undo wasting of the product because the user could not use the product contained therein for fear of possible tampering.

A pliable bottle cap with a foil safety seal thereunder is disclosed by Bullock, III in U.S. Pat. No. 4,739,891. Here a removable plastic cap covers the orifice of the container, the orifice covered by a safety seal. The user tears off the plastic cap and reveals the safety seal which must be removed by grasping the foil tab on the seal and pulling it off This seal is not unlike those previously disclosed by Ullman et al and Han and the same limitations as are previously listed herein are also apparent here. The Bullock, III disclosure does not disclose nor suggest a portion of the cap to be used as a device to remove the safety seal.

SUMMARY OF THE INVENTION

The object of the disclosed invention is to provide an easy to use bottle cap that also provides a means of removing the seal after inspection by the user. The manner of removal of the seal does not create excessive debris that can fall into the container and contaminate the contents. The disclosed invention is comprised of a two part cap. A closed upper portion functions partially as a typical bottle cap in that it has a closed upper section that is capable of presenting a barrier between the inside and the outside of the container. An addition to this upper portion of the cap is a blade that is set inside of the peripheral edge of the upper portion of the cap. A puncture means in the form of a spike or a screw may be included such that it also extends away from the closed top of the closed upper portion of the cap.

A cap portion is the second part of the invention as disclosed. The cap portion has one end that is adapted to receive the open lower end of the upper portion of the cap, thereby containing the blade and optional puncture means therein, keeping them both clean. The second end of the cap portion is adapted to receive the orifice of the container. This can be in the form of threads or an interference "snap fit" with the container, which is typically a bottle. The orifice of the bottle is fit with a safety seal to prevent contamination and alert the user as to potential contamination if the seal is broken.

To remove the seal, the combination cap is removed from the container, typically by unscrewing the cap, thereby allowing visual inspection of the safety seal. The upper portion of the cap is displaced from the lower portion of the cap, thus revealing the blade. The blade is then placed into the orifice of the container, cutting the safety seal and allowing access to the contents of the container. If a puncture means is used, it penetrates and secures the safety seal thereto. The cap is then reattached and fitted back over the orifice of the container, again acting as a cap.

DETAILED DESCRIPTION OF THE PREFERRED EMBODIMENT

In response to the current inadequacies in products in the marketplace, the following disclosure is made thus showing and describing a novel improvement relative to the current state of the art. What is disclosed herein is a container cap that facilitates the removal of the safety seal from a container.

Figure 1:
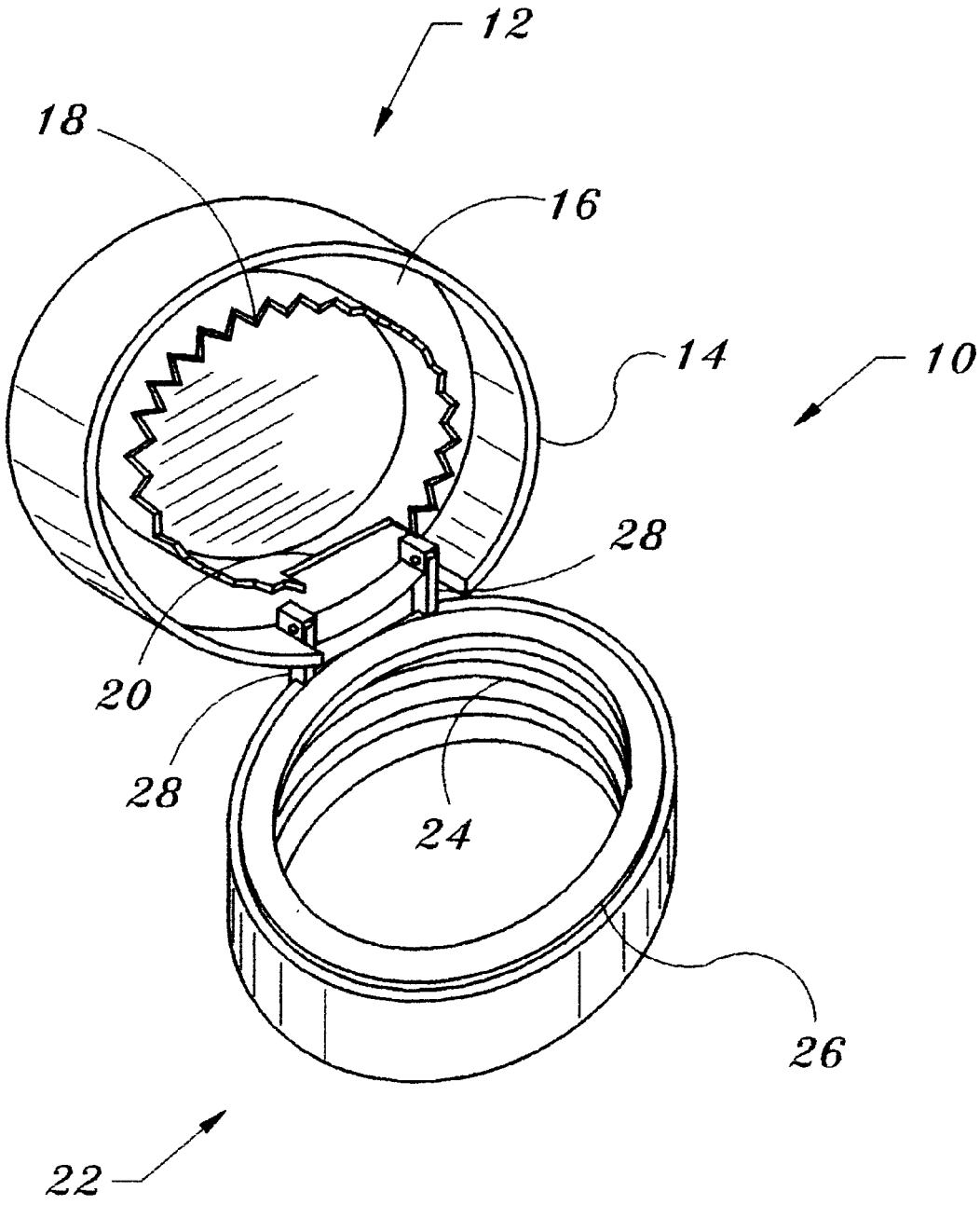
FIG. 1 is an isometric view of a two part container cap shown in the open position, the cap produced in accordance with the preferred embodiment of the present invention.

Referring to the drawings, FIG. 1 shows a container cap 10 with a two part construction. The closed upper portion 12 is comprised of an outer rim 14 which connects to a top 16, this combination is not unlike a traditional cap. A functional novelty of the device is that the top 16 supports a blade 18. The blade is shown here to be serrated to facilitate cutting, but this is not necessary to the function of the invention. The blade is shown to include a notch 20, which in turn maintains the blade in a "C" shape. This also is not a functional necessity of the invention but in this form it is found to be preferable to a continuous circular blade. Use of this aspect will be detailed later in the disclosure.

A cap portion 22 is used to connect the closed upper portion 12 to a container. This cap portion 22 is typically constructed of an open cylinder, as shown here, with one end being suitable for receiving the outer rim 14 of the closed upper portion 12. The other end of the cap portion 22 is adapted to receive the open end of a container (not shown). This may be done with an interference fit between the container and the cap portion 22 or as shown here, with internal threads 24 that may be used to releasably secure the cap portion 22 to the container.

The cap functions in removing the safety seal from a container by first allowing the removal of the cap portion 22 from the container and then displacing the upper portion 12 from the cap portion 22, as it is illustrated here. This exposes the blade 18 which is situated within the outer rim 14 of the upper portion 12. Using the outer rim 14 as a guide over the outside of the opening of the container, the blade 18 can be inserted into the inside of the opening of the container, cutting the safety seal around the opening except for the area adjacent to the notch 20. This leaves a tether for the cut seal so as not to allow it to fall into the container thereby allowing it to remain or providing a "handle" for it to be easily removed by hand. The cap can then be reassembled onto the container and access to the contents of the container can be made through the hollow portion of the cap portion 22 by simply displacing the upper portion 12.

Securing the closed upper portion 12 to the cap portion 22 is not necessary to the function of the invention but in most instances it is preferable, thereby securely closing the container. To accomplish this the invention may include an interference fit between at least a portion of the two parts. Here this is shown to be facilitated by a lip 26 on the cap portion 22. The outside edge of the lip 26 presents an interference fit with the inside edge of the outer rim 14. This enables a secure fit between the two parts to "snap" them together. The upper portion 12 is shown here to be pivotally mounted to the cap portion 22 by hinges 28. Thus enables precise and effortless location of the upper portion 12 to the cap portion 22. The components could just as easily be separate and not use the hinges 28, but the use of the hinges is desirable for the afore mentioned reasons.

Figure 2:
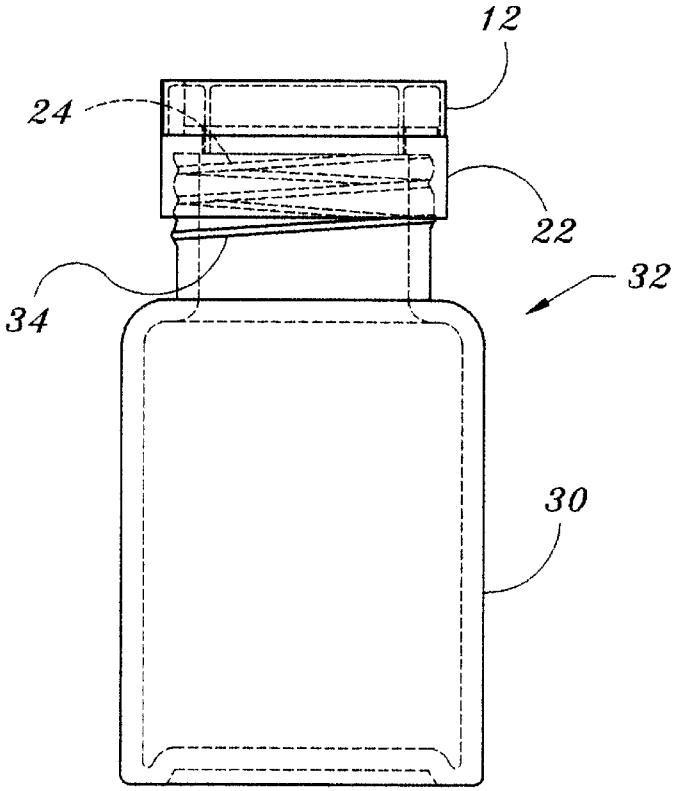
FIG. 2 is a side view of a containment system including a cap and bottle in an assembled condition, the device produced in accordance with the preferred embodiment of the present invention.

A containment system 32 is disclosed in FIG. 2 whereby the cap portion 22 and closed upper portion 12 are secured together, and the combination secured to a container 30. As shown here, the preferred embodiment of the container 30 is fastened to the cap portion 22 is by external threads 34 on the container 30 which mate with the internal threads 24 on the cap portion 22. This is a commonly used mechanism in the industry and is therefore used in illustration here. An interference fit, or snap fit would also work just as well, similar to that previously disclosed as being used to secure the upper portion 12 to the cap portion 22. The resulting combination is a containment system 32 that enables the secure closure of contents and a cap that allows easy access of the user to the contents.

Figure 3:
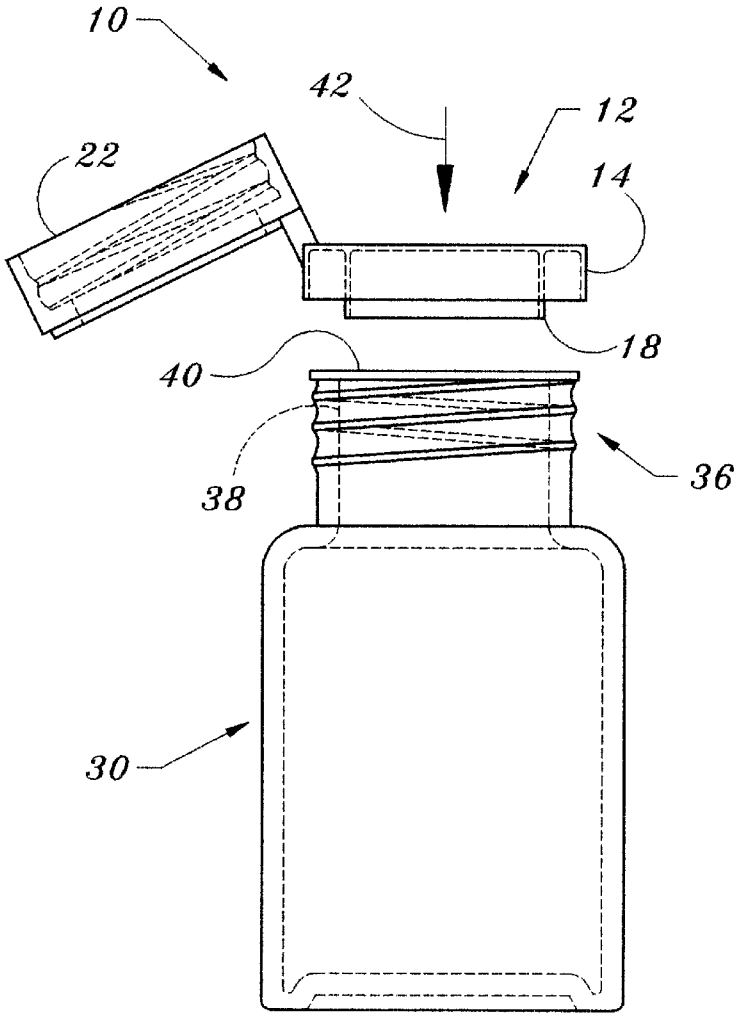
FIG. 3 is a side view of a containment system including a cap and bottle shown as it would be used to cut the safely seal from the container, the device produced in accordance with the preferred embodiment of the present invention.

The novelty of this containment system is further disclosed in FIG. 3, wherein the cap portion 22 is displaced from the closed upper portion 12. The upper portion 12 is positioned above the container 30 so as to allow the outer rim 14 to pass over the neck 36 of the container 30 while the blade 18 is positioned to pass through the orifice 38. Here the blade 18 is shown without serrations as was previously disclosed. Depending upon the material to be cut by the blade and the structure of the cutting edge would determine the desirability of the serrations on the blade. Either method would be functional to the utility of the disclosure of the present invention.

A safety seal 40 is secured to the top edge of the neck 36 thereby covering the orifice 38 thus providing a protective seal that if were broken would be obvious upon inspection after removal of the cap 10. By displacing the upper portion 12 of the cap 10 toward the container 30, in the direction of the arrow 42, the blade 18 will cut through the seal 40 in one movement. The cap 10 is then pulled away from the container 30, and after reassembling the upper portion 12 to the cap portion 22 the combination can be again secured to the container 30.

Figure 4:
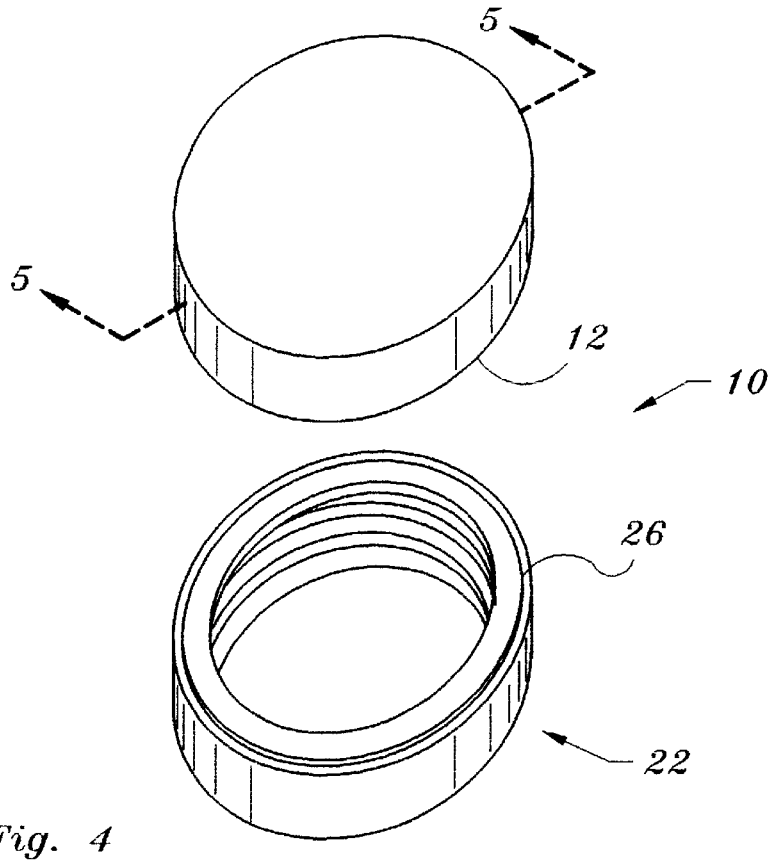
FIG. 4 is an isometric view of a two part container cap shown in the open or disassembled position, the cap produced in accordance with the preferred embodiment of the present invention.

Another version of the preferred embodiment of the present invention is shown in FIG. 4. Here the two parts of the cap 10, the upper portion 12 and the cap portion 22 are shown as not being pivotally mounted one to another but instead being completely detachable from each other. The same type of lip 26 on the cap portion 22 is shown here to be used to releasably secure the upper portion 12 to the cap portion 22, but any type of fastening means could conceivably be used including a threaded section on each part that would enable the parts to be screwed together or apart. A modification to the upper portion 12 has been made that will be detailed in the section view that follows.

Another variation to the cap 10 is not shown here in that the cap portion 22 is, as before, cylindrical with an open center to allow for the material of the container to pass there through. Though this is considered to be the preferred embodiment of the invention, this does not preclude the functional aspects of the invention if the cap portion 22 had a closed top, as a traditional cap. The closed upper portion 12 could be used once to cut and remove the safety seal on the container and then discarded with or without the center portion of the safety seal. The remaining cap portion 22 is then used as a typical cap to the container. This is also considered to be an embodiment of the disclosed invention.

Figure 5:
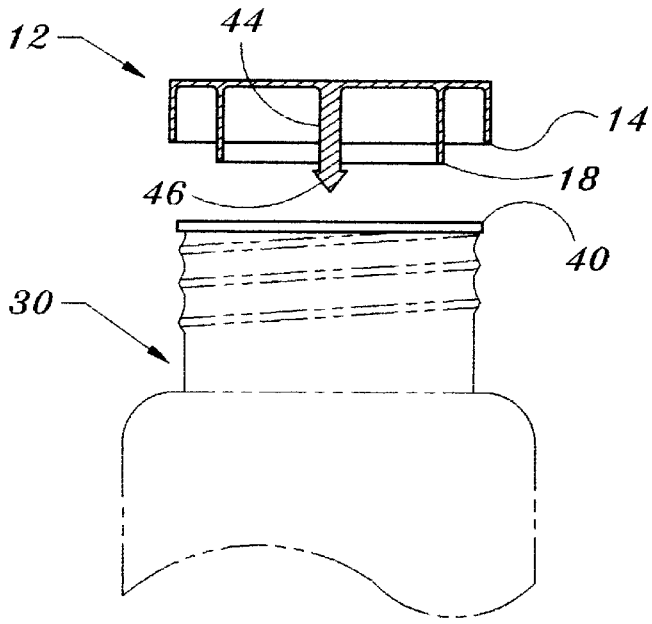
FIG. 5 is a sectioned view along the line 5—5 shown in FIG. 4 showing the functional elements of the cap as it would fit on a container, the cap produced in accordance with the preferred embodiment of the present invention.
Figure 5A:
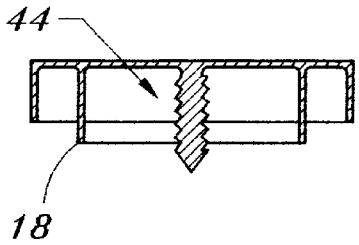
FIG. 5*a* is a sectioned view similar to that shown in FIG. 5 of the functional elements of the cap including a helical barb, the cap produced in accordance with an alternative preferred embodiment of the present invention

A sectioned view along line 5—5 of the upper portion 12 of the cap 10 is shown in FIG. 5 the detail showing the addition of a puncture means 44. The function of the puncture means 44 is to penetrate and secure the safety seal 40 to the upper portion 12 so that the entire center portion of the safety seal 40 can be cut away from the container 30 and not fall into the container 30 after being cut there from. A barb 46 is shown here to be positioned on the end of the puncture means 44. This barb 46 aids in retaining the cut seal 40 on the puncture means 44. In addition to a barb 46, a variety of retaining means could be used. One such example is a helical coil, such as in a threaded screw, as shown in FIG. 5*a*. This necessitates the upper portion 12 of the cap to be able to rotate about the orifice of the container 30 whereby the puncture means 44 which here is shown to be comprised of a helical coil or screw threads, is "screwed" into the center of the seal 40 and then the blade 18 would cut the seal 40. This rotating action could also be used in cutting the seal 40 with the blade 18 or it could be rotated to contact the blade 18 to the seal 40 and then cut through the seal 40 in a linear motion. The rotating action suggests the container 30 and cap structures to be round, but with a linear cutting motion the shape of the upper portion 12 and container 30 are not relevant, any shape would function equally well.

Figure 5B:
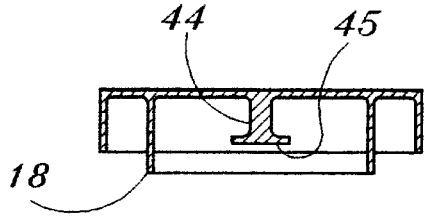
FIG. 5*b* is a sectioned view similar to that shown in FIG. 5 of the functional elements of the cap including an adhesive on the upper portion, the cap produced in accordance with an alternative preferred embodiment of the present invention.

Another version of the puncture means, which is shown in FIG 5*b*, is similar to that previously disclosed only with a blunt end instead of a sharp point or barb. In this case the blunt end 45 of the puncture means 44 is not intended to actually puncture the safety seal but contact and secure it by use of a fastening means such as an adhesive located on the blunt end 45. This adhesive would be positioned on the blunt end of the puncture means and upon contacting the seal, attach thereto. At the same time the blade portion would cut the safety seal away from the container. The seal is then retained by the upper portion in a similar manner and can be discarded or retained therein as part of the cap assembly.

The function of the blade 18 and the outer rim 14 are the same as previously disclosed. In this figure, as well as in the previous, the blade 18 is shown to protrude below the bottom edge of the outer rim 14. This is done solely for the sake of illustration and in many cases it would be desirable for the blade to stay above the bottom edge of the outer rim 14 because the outer rim 14 is what guides the upper portion 12 and therefore the blade 18 into the orifice of the container 30. Such variations are considered to be design alternatives, each of which fall within the scope of this disclosure.

One important aspect of positioning is in the puncture means 44. Here it is shown to extend below the bottom edge of the blade 18. This is important because in order for the puncture means 44 to penetrate the safety seal 40 the seal 40 must be secure. If the blade 18 has already cut the seal 40 then the seal 40 would not be held secure and the puncture means 44 would not be able to penetrate it and secure it with the barb 46.

Figure 6A:
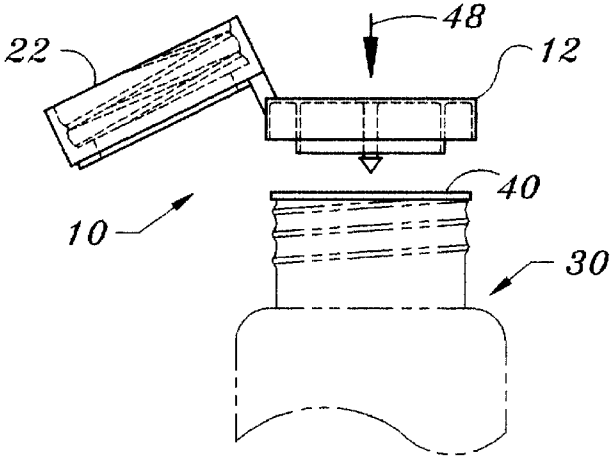
FIG. 6 is a four part side view showing the use of the cap to remove a safety seal from a container and then as a traditional cap for the container, the cap produced in accordance with the preferred embodiment of the present invention.
Figure 6B:
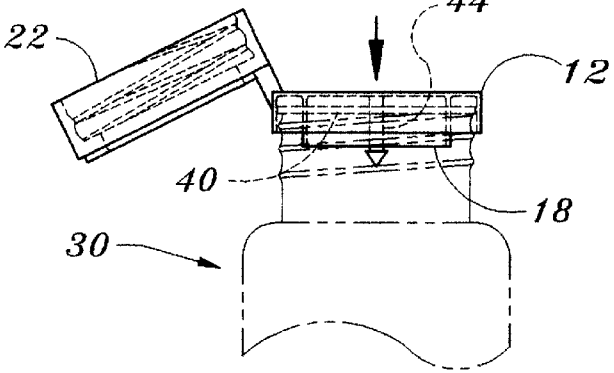

The sequence of events in removing the safety seal is shown in FIG. 6*a–d*. In FIG. 6*a* the cap 10 is shown in position over the container 30. The safety seal 40 is shown to be in one piece over the orifice of the container 30. The arrow 48 directs the movement of the upper portion 12 toward the seal 40 with the cap portion 22 displaced so as to allow the upper portion 12 access to the orifice of the container 30. The upper portion 12 of the cap 10 has penetrated the container 30 in FIG. 6*b*. The blade 18 has cut through the seal 40 with the puncture means 44 first penetrating same.

Figure 6C:
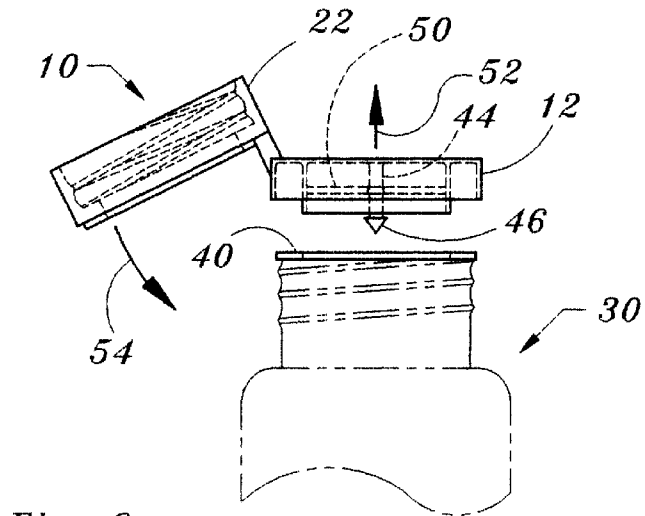

The upward movement of the cap 10 relative to the container 30 is depicted by the arrow 52 in FIG. 6*c*. Here the cut seal 50 is secured to the upper portion by use of the barb 46 on the end of the puncture means 44. This provides an opening through the seal 40 to allow access to the material inside the container 30. To reassemble the cap 10, the cap portion 22 is rotated in the direction of the arrow 54 relative to the upper portion 12. The two parts are likely, but not necessarily secured together by one of the methods previously mentioned or another common to the function of releasably fastening parts.

Figure 6D:
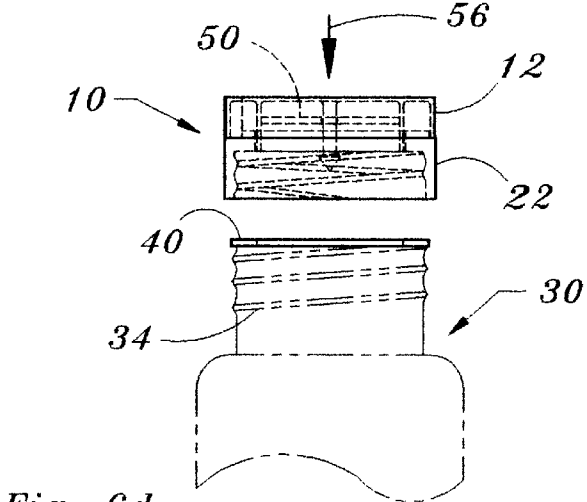

With the parts reassembled, as shown in FIG. 6*d*, the cap 10 can again be secured to the container 30 in any suitable manner, here shown by use of threads 34. The arrow 56 shows the displacement of the cap 10 to secure the container 30 with the cut seal 50 retained within the upper portion 12 of the cap 10 and the remaining portion of the seal 40 on the container 30. In this case, since the upper portion 12 and the cap portion 22 are pivotally mounted to one another, the upper portion 12 can be "popped" open, taking with it the cut seal 50, and allowing access to the container 30 without unscrewing the cap 10. This then allows for convenient storage of the material and an easy method for removal of the safety seal from the container 30. This seal removal is done after inspection of the integrity of the seal, any disturbance to the seal alerting the user as to potential pre-use tampering of the material.

What is claimed is:

1. A two part container cap comprising:

a closed upper portion including an arcuate blade portion being capable of cutting through a safely seal on a container; and a cap portion that is releasably secured to said upper portion and includes a first end and a second end, the first end being capable of receiving said closed upper portion and the second end adapted to be releasably secured about an orifice of a container, whereby the blade portion of the closed upper portion can be projected into the orifice of the container, the blade thereby cutting at least a portion of the safety seal from the orifice and the closed upper portion can also be releasably secured to the first end of the cap portion.

2. The container cap as described in claim 1, wherein said arcuate blade portion is not continuous, thereby providing a portion of said safety seal to remain in contact with the orifice of the container.

3. The container cap as described in claim 2, wherein said annular blade portion has a "C" shape.

4. The container cap as described in claim 1, wherein said blade portion includes a serrated cutting edge to facilitate cutting through the safely seal.

5. The container cap as described in claim 1, wherein said cap portion includes an opening from said first end to said second end thereof, thereby allowing passage of material through said cap portion.

6. The container cap as described in claim 5, wherein said closed upper portion is pivotally mounted to said cap portion.

7. The container cap as described in claim 1, wherein said first end of said cap portion includes a closed portion, thereby the cap portion to close a container in the absence of said closed upper portion.

8. The container cap as described in claim 7, wherein said closed upper portion is releasably mounted to the first end of said cap portion by use of an interference fit, thus allowing the parts to be releasably secured one to another.

9. The container cap as described in claim 1, wherein said closed upper portion is further comprised of an outer rim which is capable of receiving said orifice of said container therein and said blade portion located inside the peripheral edge of the outer rim, whereby the outer rim can be placed around the orifice of the container thus properly locating the blade portion to cut the safety seal in close proximity to the edge of the orifice.

10. The container cap as described in claim 9, wherein said outer rim is comprised of a lip that provides an interference fit with said first end of said cap portion.

11. The container cap as described in claim 1, wherein said second end of said cap portion is adapted to releasably secure to an orifice of a container by virtue of internal threads on said cap which mate with external threads near the orifice of the container.

12. The container cap as described in claim 1, wherein said second end of said cap portion is adapted to releasably secure to an orifice of a container by virtue of an interference fit between said cap and a rim near the orifice of the container.

13. A two part container cap comprising:

closed upper portion including an annular blade portion, the blade portion being capable of cutting through a safely seal on a container;

a substantially longitudinal puncture means extending from said closed upper portion and located within the perimeter of said annular blade portion; and a cap portion that is releasably secured to said upper portion and includes a first end and a second end, the first end being capable of receiving said closed upper portion and the second end adapted to be releasably secured to an orifice of a container, whereby the blade portion and said puncture means of the closed upper portion can be projected into the orifice of the container, the puncture means penetrating and securing the safety seal and the blade cutting the safety seal near the orifice, and the closed upper portion can also be releasably secured to the first end of the cap portion.

14. The container cap as described in claim 13, wherein said blade portion includes a serrated cutting edge to facilitate cutting through the safety seal.

15. The container cap as described in claim 13, wherein said cap portion includes an opening from said first end to said second end thereof, thereby allowing passage of material through said cap portion.

16. The container cap as described in claim 15, wherein said closed upper portion is pivotally mounted to said cap portion.

17. The container cap as described in claim 13, wherein said first end of said cap portion includes a closed portion, thereby the cap portion to close a container in the absence of said closed upper portion.

18. The container cap as described in claim 17, wherein said closed upper portion is releasably mounted to the first end of said cap portion by use of an interference fit, thus allowing the parts to be releasably secured one to another.

19. The container cap as described in claim 13, wherein said closed upper portion is further comprised of an outer rim which is capable of receiving said orifice of said container therein and said blade portion located inside the peripheral edge of the outer rim, whereby the outer rim can be placed around the orifice of the container thus properly locating the blade portion to cut the safety seal in close proximity to the edge of the orifice.

20. The container cap as described in claim 19, wherein said outer rim is comprised of a lip that provides an interference fit with said first end of said cap portion.

21. The container cap as described in claim 13, wherein said puncture means includes an helical edge, whereby upon twisting said closed upper portion on said container lifts the safety seal toward the closed upper portion.

22. The container cap as described in claim 13, wherein said puncture means includes a barbed portion located on the end thereof to facilitate retaining said safety seal after penetrating same with said puncture means.

23. The container cap as described in claim 13, wherein said second end of said cap portion is adapted to releasably secure to an orifice of a container by virtue of internal threads on said cap which mate with external threads near the orifice of the container.

24. The container cap as described in claim 13, wherein said second end of said cap portion is adapted to releasably secure to an orifice of a container by virtue of an interference fit between said cap and a rim near the orifice of the container.

25. The container cap as described in claim 13, wherein said puncture means is comprised of a support means with a distal end supporting an adhesive, whereby the adhesive is capable of securing said safety seal after being cut with said blade portion.

26. A containment system comprising:

a container having an orifice and a safety seal over the orifice; and a two part container cap including:

a closed upper portion including an arcuate blade portion being capable of cutting through the safely seal on the container; and a cap portion that is releasably secured to said upper portion and includes a first end and a second end, the first end being capable of receiving said closed upper portion and the second end adapted to be releasably secured about the orifice of the container, whereby the blade portion of the closed upper portion can be projected into the orifice of the container, the blade thereby cutting at least a portion of the safety seal from the orifice, allowing access to the contents of the container, and the closed upper portion can also be releasably secured to the first end of the cap portion.

27. The containment system as described in claim 26, whereby said closed upper cap is further comprised of a substantially longitudinal puncture means located adjacent to said blade portion, the puncture means capable of retaining said safety seal after being cut from said container by said blade portion.

28. The containment system as described in claim 26, wherein said puncture means includes a helical edge, whereby upon twisting said closed upper portion on said container lifts the safety seal toward the closed upper portion.

29. The containment system as described in claim 26, wherein said puncture means includes a barbed portion located on the end thereof to facilitate retaining said safety seal upon penetrating same with said puncture means.

30. The containment system as described in claim 26, wherein said blade portion includes a serrated cutting edge to facilitate cutting through the safely seal.

31. The containment system as described in claim 26, wherein said cap portion includes an opening from said first end to said second end thereof, thereby allowing passage of material through said cap portion.

32. The containment system as described in claim 31, wherein said closed upper portion is pivotally mounted to the first end of said cap portion.

33. The containment system as described in claim 31, wherein said closed upper portion is releasably mounted to the first end of said cap portion by use of an interference fit, thus allowing the parts to be releasably secured one to another.

34. The containment system as described in claim 26, wherein said closed upper portion is further comprised of an outer rim which is capable of receiving said orifice of said container therein and said blade portion located inside the peripheral edge of the outer rim, whereby the outer rim can be placed around the orifice of the container thus properly locating the blade portion to cut the safety seal in close proximity to the edge of the orifice.

35. The containment system as described in claim 34, wherein said outer rim is comprised of a lip that provides an interference fit with said first end of said cap portion.

36. The containment system as described in claim 26, wherein said second end of said cap portion is adapted to releasably secure to an orifice of a container by virtue of internal threads on said cap which mate with external threads near the orifice of the container.

37. The containment system as described in claim 26, wherein said second end of said cap portion is adapted to releasably secure to an orifice of a container by virtue of an interference fit between said cap and a rim near the orifice of the container.

* * * * *